US007897856B2

(12) United States Patent
Shinjo

(10) Patent No.: US 7,897,856 B2
(45) Date of Patent: Mar. 1, 2011

(54) CASING STRUCTURE OF ELECTRONIC MUSICAL INSTRUMENT

(75) Inventor: Akiko Shinjo, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 12/644,824

(22) Filed: Dec. 22, 2009

(65) Prior Publication Data

US 2010/0154615 A1 Jun. 24, 2010

(30) Foreign Application Priority Data

Dec. 22, 2008 (JP) ..... 2008-325686

(51) Int. Cl.
*G10F 1/22* (2006.01)

(52) U.S. Cl. ..... 84/2

(58) Field of Classification Search ..... 84/2, 3, 84/7, 13, 19, 79, 423 R, 441
See application file for complete search history.

(56) References Cited

U.S. PATENT DOCUMENTS

2010/0071532 A1* 3/2010 Kitajima et al. ..... 84/432

FOREIGN PATENT DOCUMENTS

JP 2007-233190 9/2007

* cited by examiner

*Primary Examiner* — Kimberly R Lockett
(74) *Attorney, Agent, or Firm* — Morrison & Foerster LLP

(57) ABSTRACT

When a middle plate is to be mounted to an accommodating section surrounded by left and right and rear side plates provided on a body section in a casing structure of a grand-piano type electronic piano, the middle plate positioned in front of the accommodating section is slid rearward, so that a rear end edge portion of the middle plate is fitted into a fitting section provided on the inner surface of the rear side plate and then fixing pieces provided on the underside of the middle plate are fixed to fixation pieces provided on the accommodating section by means of bolts. Such an arrangement can reduce the number of portions to be fixed by bolts and thereby mount the middle plate with an enhanced mounting efficiency. Because the bolts do not appear on the exterior of the electronic piano, the electronic piano can have an enhanced outer appearance design.

6 Claims, 8 Drawing Sheets

CASING STRUCTURE OF ELECTRONIC MUSICAL INSTRUMENT

BACKGROUND

The present invention relates an electronic musical instrument casing structure suited for application to electronic pianos having an outer appearance like that of a grand piano.

Heretofore, there have been known electronic pianos (electronic musical instruments) having an outer appearance like that of a grand piano, one example of which is disclosed in Japanese Patent Application Laid-open Publication No. 2007-233190 (hereinafter referred to as "the patent literature"). The electronic piano disclosed in the patent literature includes a casing structure where an accommodating section is provided behind a keyboard and surrounded by side plates defining an outer shape of the electronic piano. Back lid is provided on an opening portion at the top of the accommodating section in such a manner that it can open or close the opening portion as necessary. Plate-shaped member, referred to as "sound board" in the patent literature, having a plurality of speakers arranged thereon is provided within the accommodating section.

In the acoustic piano, where strings are provided within the accommodating section, a sound board corresponding to the aforementioned plate-shaped member is provided in the accommodating section beneath the strings and a frame. In the electronic piano, on the other hand, the plate-shaped member is provided near the top opening portion of the accommodating section close to the back lid.

Thus, when the back lid is in the opened position, the plate-shaped member undesirably appears on the exterior of the electronic piano; namely, the plate-shaped member is undesirably visible from outside the electronic piano.

Further, in the electronic piano disclosed in the patent literature, a fixation structure comprising fastener members, such as bolts, is used for fixing the plate-shaped member to side plates etc. of the body section of the electronic piano. However, because the plate-shaped member is an externally exposed component part in the electronic piano, the bolts fixing the plate-shaped member may also be undesirably visible from outside the electronic piano, which would undesirably impair the outer appearance of the electronic piano. Further, the plate-shaped member provided in the accommodating section is relatively large in size, and thus, if the plate-shaped member is fastened with many bolts, it must be bolted at many portions one by one over a relatively wide range, so that the mounting operations of the plate-shaped member would require much time and labor.

If the plate-shaped member is fixed by adhesive, no fastener members, such as bolts, would not be exposed outside of the electronic piano. However, such fixation by adhesive can not achieve a high degree of freedom of mounting and connection between the component parts of the electronic piano. Further, the fixation by adhesive alone may not be able to fix the component parts with a sufficient strength.

Further, if the plate-shaped member is formed of a natural material, such as wood, there would occur a deviation, from a designed size, of an actual size of the plate-shaped member. Thus, it is desirable that the fixation structure for the plate-shaped member be one capable of absorbing (tolerating) as much as possible influences of a deviation in actual size of the plate-shaped member and deformation of the plate-shaped member. Further, if the plate-shaped member influences acoustic characteristics of electronic component parts, such as the sound board, it is desired that the fixation structure for the plate-shaped member be constructed so as to enhance an acoustic effect of the casing including the plate-shaped member.

SUMMARY OF THE INVENTION

In view of the foregoing, it is an object of the present invention to provide an improved casing structure of an electronic musical instrument which allows the plate-shaped member to be assembled to the casing with an enhanced efficiency, can enhance tolerances against deformation and deviation in actual size of the plate-shaped member, and which permits an enhanced acoustic effect of the casing.

In order to accomplish the above-mentioned object, the present invention provides an improved casing structure of an electronic musical instrument, which comprises: a body section; an accommodating section provided in said body section and having at least one portion thereof adapted to be opened; a plate-shaped member to be mounted to said accommodating section; a fitting section provided on said body section for fitting therein part of an end edge portion of said plate-shaped member; fixation portions provided on left and right side regions of a surface of said plate-shaped member facing inwardly of said accommodating section and adapted to be fixed to said body section; and fastener members for fastening and fixing said fixation portions to corresponding portions provided on said body section in correspondence with said fixation portions, wherein said plate-shaped member is mounted to said accommodating section by said fixation portions being fastened and fixed to said corresponding portions by means of said fastener members with the part of the end edge portion of said plate-shaped member fitted in said fitting section.

With the casing structure of the present invention, where the plate-shaped member is mounted to the accommodating section by the end edge portion of the plate-shaped member being fitted into the fitting section, it is possible to minimize the number of portions to be fixed by fastener members, such as bolts. Thus, the casing structure of the present invention can facilitate mounting operations of the plate-shaped member and thereby permits an enhanced assembling efficiency of the casing of the electronic musical instrument. Further, because the plate-shaped member is mounted to the accommodating section by the end edge portion of the plate-shaped member being fitted into the fitting section, the casing structure of the present invention can achieve enhanced tolerances against a deviation, from a designed size, of an actual size of the plate-shaped member and deformation of the plate-shaped member, as compared to cases where the plate-shaped member is fixed to the body section by fastener members, such as bolts, alone. As a result, the casing structure of the present invention can not only facilitate the mounting operations of the plate-shaped member but also stabilize a fixed state of the plate-shaped member after the mounting. Further, because the fixation portion to be fixed by the fastener member is provided on the surface of the plate-shaped member facing inwardly of the accommodating section, the present invention can prevent the fastener member from appearing on the exterior of the electronic musical instrument, i.e. from being visible from outside the electronic musical instrument. As a result, the casing structure of the present invention allows the electronic piano to have an improved outer appearance with, for example, a sense of high quality.

In an embodiment of the present invention, a resilient shock absorbing portion is provided on at least one of the fitting section and the end edge portion of the plate-shaped member to be fitted into the fitting section. With such an arrangement, the present invention allows the end edge portion of the plate-shaped member to resiliently fit into the fitting section and thereby can even further facilitate the mounting operations of the plate-shaped member. Further, the present invention can achieve even further enhanced tolerances against a deviation of the actual size and deformation of the plate-shaped member but also stabilize the fixed state of the plate-shaped member after the mounting.

In an embodiment of the present invention, a speaker is provided in the accommodating section, and, by the plate-shaped member mounted to the accommodating section, at least part of the speaker is hidden to be invisible from outside the accommodating section. This arrangement can even further enhance the outer appearance design of the electronic musical instrument.

In an embodiment of the present invention, the speaker comprises a plurality of speakers placed on a speaker placing surface in the accommodating section, the speaker placing surface facing the plate-shaped member mounted to the accommodating section, and the plate-shaped member has sound emitting holes formed in positions thereof corresponding to individual ones of the plurality of speakers, a gap being defined between the plate-shaped member mounted to the accommodating section and the speaker placing surface. Sounds emitted through the sound emitting holes are combinations of so-called direct sounds generated by the speakers and emitted directly through the sound emitting holes and so-called indirect sounds generated by the speakers and then emitted through the sound emitting holes after being mixed together by being reflected in the gap defined between the plate-shaped member mounted to the accommodating section and the speaker placing surface. With the direct sounds alone, the sounds of the speakers would sound separately and give a listener an impression as if a plurality of point sound sources were generating the sounds. However, by the indirect sounds being combined with the direct sounds, it is possible to give the human listener an impression as if a plurality of surface sound sources were generating the sounds. Thus, with the casing structure of the present invention constructed in the aforementioned manner, an acoustic effect very similar to that achieved by a soundboard of an acoustic piano or the like can be obtained by the casing of the electronic musical instrument. As a result, the casing structure of the present invention can significantly improve the acoustic effect provided by the casing of the electronic musical instrument.

In an embodiment of the present invention, the accommodating section is disposed in a rear region of the body section opposite from a human player of the electronic musical instrument, the fitting section is provided on a rear side plate surrounding a rear side of the accommodating section or surrounding a region of the accommodating section extending from the rear side to at least portions of left and right sides of the accommodating section, and the end edge portion of the accommodating section is fitted into the fitting section as the plate-shaped member is moved in the accommodating section from a human player side toward the rear side. Thus, when the plate-shaped member is to be mounted to the accommodating section, the end edge portion of the plate-shaped member can be fitted into the fitting section and mounted in place by the plate-shaped member being merely slid in one direction. Therefore, the casing structure of the present invention can facilitate the mounting operations of the plate-shaped member and achieve an enhanced mounting ease of the plate-shaped member.

In a preferred implementation of the present invention, the plate-shaped member comprises a first plate-shaped member to be fitted into a first setting section provided in the body section and a second plate-shaped member to be mounted to the mounting section together with the first plate-shaped member, and further comprises: a second fitting section provided on another end edge portion of the first plate-shaped member than the end edge portion to be fitted into the first setting section, part of an end edge portion of the second plate-shaped member being fitted into the second fitting section; a second fixation portion provided on a surface of the second plate-shaped member facing inwardly of the accommodating section and adapted to be fixed to the body section; and a second fastener member for fastening and fixing the second fixation portion to the body section. In this case, the second plate-shaped member is mounted to the accommodating section by the part of the end edge portion of the second plate-shaped member being fitted into the second fitting section and the second fixation portion being fastened and fixed to the body section by means of the second fastener member with the first plate-shaped member mounted to the accommodating section. With such an arrangement, the second plate-shaped member can be mounted to the accommodating section using the second fitting section provided on the first plate-shaped member. Thus, although two (i.e., first and second) plate-shaped members are to be mounted to the accommodating section, the present invention can minimize the number of portions to be fixed by fastener members, such as bolts. Further, because the second fixation portion is provided on the surface of the second plate-shaped member facing inwardly of the accommodating section, it can be made invisible from outside the accommodating section and hence the electronic musical instrument, and thus, the electronic musical instrument can have an even further enhanced outer design. Furthermore, if an arrangement is made for causing only a selected one of the two plate-shaped members to vibrate in response to tone generation by the electronic musical instrument, it is also possible to diversify the acoustic effect achievable by the casing of the electronic musical instrument. Furthermore, different materials can be used for one of the plate-shaped members that influences the acoustic effect and the other plate-shaped member. Thus, it is possible to effectively reduce the necessary manufacturing cost while enhancing the acoustic effect of the electronic musical instrument.

The casing structure of an electronic musical instrument of the present invention allows the plate-shaped member to be assembled to the casing of the electronic musical instrument with an enhanced efficiency and ease, can enhance tolerances against deformation and deviation in actual size of the plate-shaped member, and permits an enhanced acoustic effect of the casing.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the object and other features of the present invention, its preferred embodiments will be described hereinbelow in greater detail with reference to the accompanying drawings, in which.

DETAILED DESCRIPTION

Figure 1:
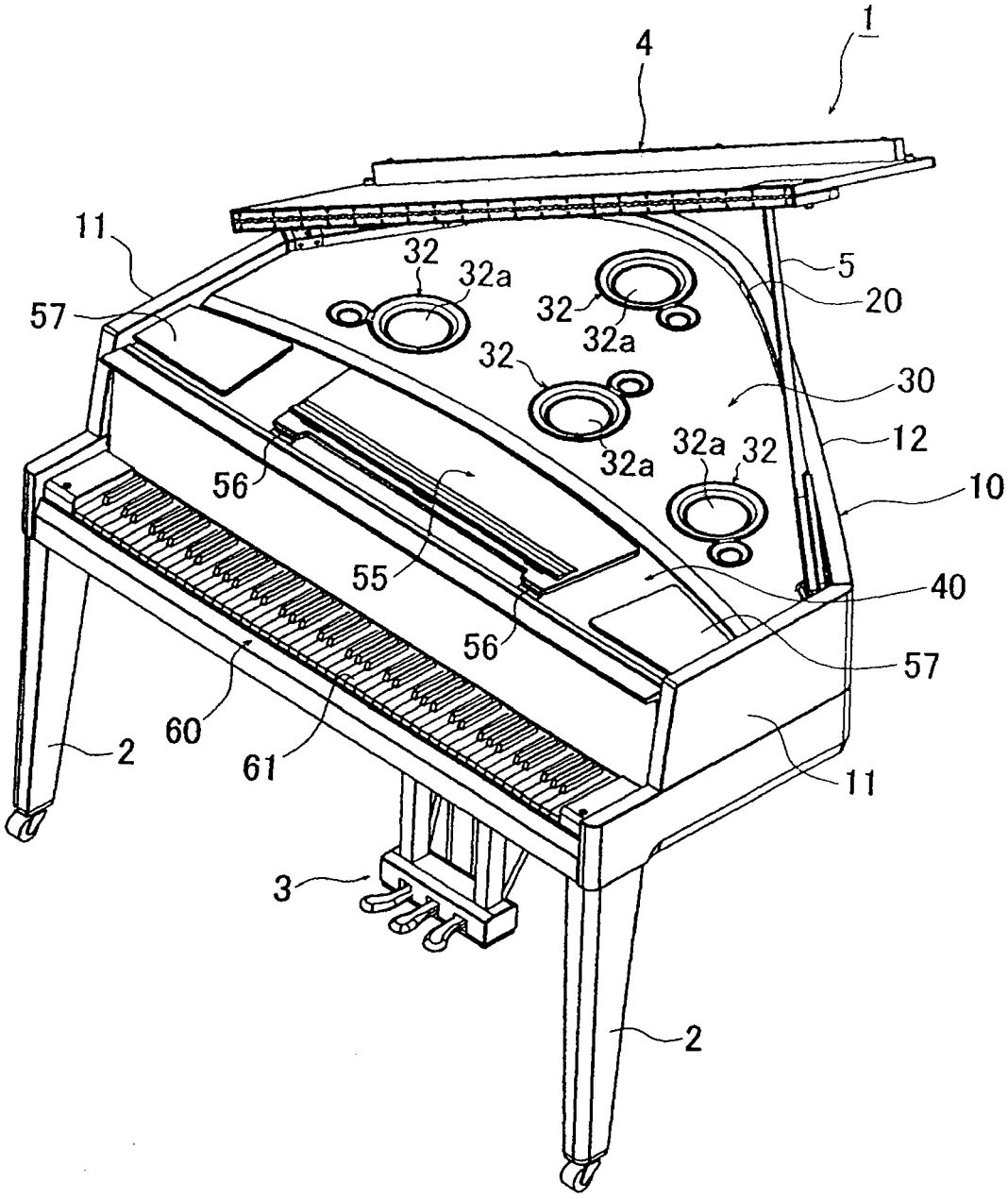
FIG. 1 is a perspective view showing an overall construction of an electronic piano employing a casing structure according to an embodiment of the present invention.
Figure 2:
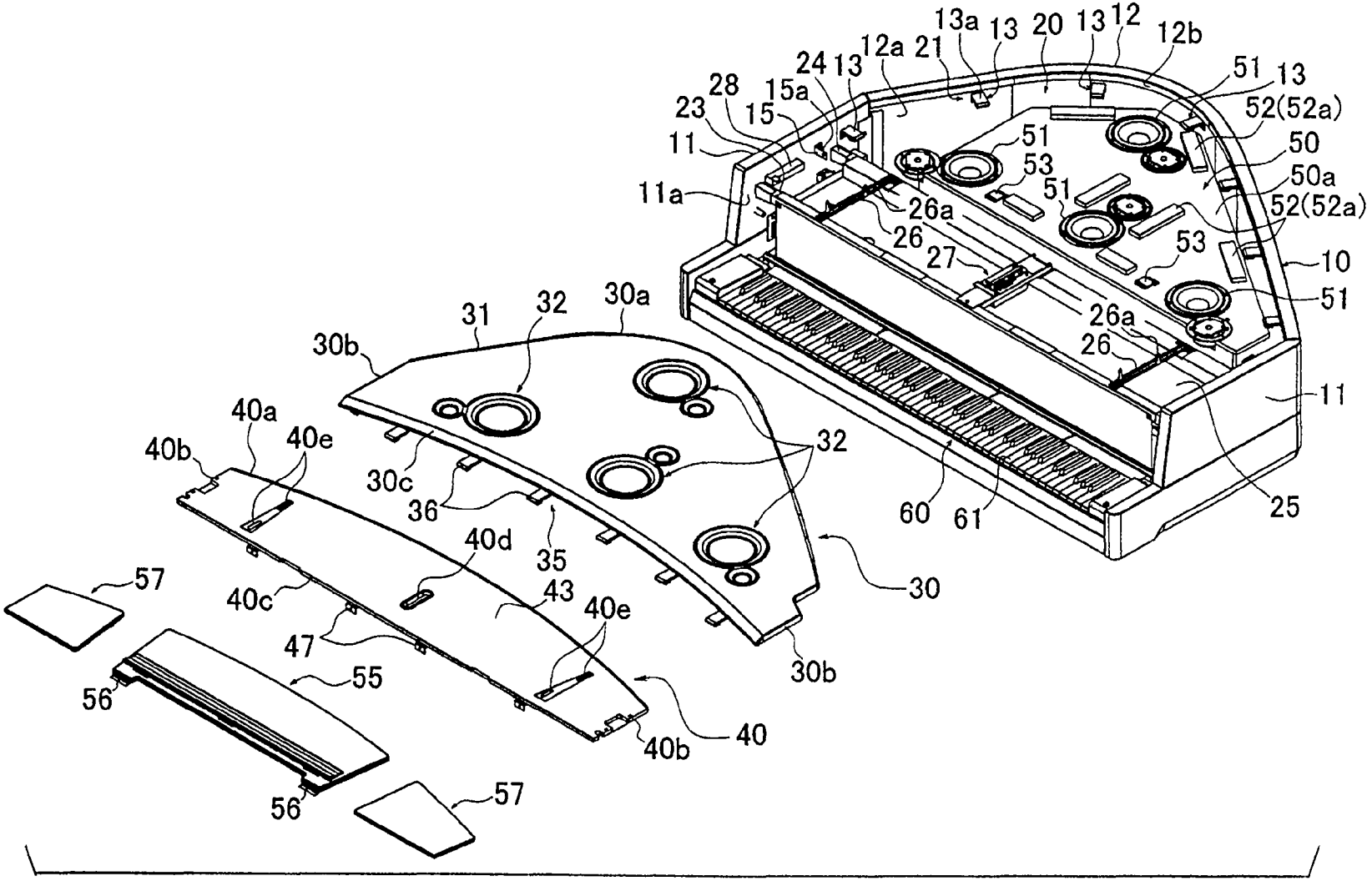
FIG. 2 is an exploded perspective view showing a construction of a body section of the electronic piano.

FIGS. 1 and 2 show an electronic piano (electronic musical instrument) 1 equipped with a casing structure according to an embodiment of the present invention, of which FIG. 1 is a perspective view showing an overall construction of the electronic piano 1 while FIG. 2 is an exploded perspective view showing a construction of a body section 10 of the electronic piano 1. The electronic piano 1 includes the body section 10, three legs 2 supporting the body section 10, a pedal unit 3 mounted to the underside of the body section 10, etc. Note that illustration of the legs 2 and the pedal unit 3 is omitted in FIG. 2 and succeeding figures. Further, in the following description, one side region of the body section 10 closer to a human player will be referred to as "front side", and another side region of the body section 10 opposite from the human player or front side will be referred to as "rear side". Further, a direction in which keys 61 of a keyboard 60 are arranged or arrayed will be referred to as "horizontal direction" or "left-right direction".

In the body section 10, the keyboard 60 having a plurality of keys 61 arrayed thereon is provided on the front side, and an accommodating section 20 is provided behind the keyboard 60. The accommodating section 20 is defined by a pair of left and right side plates 11 surrounding the left and right sides of the body section 10 and a rear side plate 12 surrounding the rear side of the body section 10. The accommodating section 20 has, at its upper end, an opening portion 20*a* that opens upwardly, and a back lid 4 openable and closeable by vertically pivoting about its one side is provided on the opening portion 20*a*. Further, a lid prop 5 is provided for supporting the back lid 4 in a raised position. Further, as shown in FIG. 2, a speaker box 50 having a plurality of speakers 51 is accommodated in a rear region of the accommodating section 20. Two horizontal support members 23 and 24, each having a rectangular columnar shape, are provided in the accommodating section 20 in front of the speaker box 50 and spaced from each other by a predetermined distance in the front-rear direction, and the support members 23 and 24 span between and are fixed to respective inner surfaces 11*a* of the left and right side plates 11. A mounting plate 25 having a flat plate shape is provided on and spans between the support members 23 and 24, and electronic component parts, such as a circuit board, are mounted on the mounting plate 25 although not specifically shown. Further, in the accommodating section 20 are mounted a middle plate (first plate-shaped member) 30 closing a rear region of the opening portion 20*a* and a soundboard (second plate-shaped member) 40 closing a front region of the opening portion 20*a* in front of the middle plate 30. Furthermore, a music rest 55 is provided on a horizontally middle portion of the upper surface 43 of the soundboard 40, and a pair of decorative rests 57 are provided adjacent to the left and right sides of the music rest 55.

The rear side plate 12 of the body section 10 is a curved plate-shaped member formed of wood or the like and surrounds a rear portion of the accommodating section 20 extending from the rear end of the accommodating section 20 to left and right sides of the accommodating section 20. The left and right side plates 11, which are each a generally flat plate-shaped member formed of wood or the like, extend in the front-rear direction to interconnect the left and right rear ends of the rear side plate 12 and the left and right ends of the keyboard 60. A fitting section 21, into which a rear end edge portion 30*a* of the middle plate 30 is fitted, is provided on the inner surface 12*a* (facing the accommodating section 20) of the rear side plate 12. The fitting section 21, which is a laterally-inwardly facing channel-shaped section, includes a stepped portion 12*b* provided on and along the upper end of the rear side plate 12 and projecting into the accommodating section 20, and a plurality of angle members 13 provided immediately beneath the stepped portion 12*b*. More specifically, the stepped portion 12*b* is in the form of a projection having a generally rectangular cross-sectional shape formed on and along the inner periphery of the opening portion 20*a*. Each of the angle members 13 is a metal member of an L shape having two portions, and one of the two portions is fixed to the inner surface 12*a* of the rear side plate 12 while the other portion 12 extends horizontally from the inner surface 12*a* of the rear side plate 12 inwardly of the accommodating section 20. The fitting section 21 is defined by or between the angle members 13 and the stepped portion 12*b*. The fitting section 21 has a vertical dimension substantially equal to the thickness of the rear end edge portion 30*a* of the middle plate 30, so that the rear end edge portion 30*a* of the middle plate 30 is sandwiched vertically or in its thickness direction by the fitting section 21. The angle members 13 are provided at predetermined horizontal intervals along the inner peripheral edge of the rear side plate 12. Further, a cushion member (i.e., shock absorbing member) 13*a*, formed of a resilient material like urethane, is affixed to the upper surface of the above-mentioned other portion of each of the angle members 13.

Figure 3A:
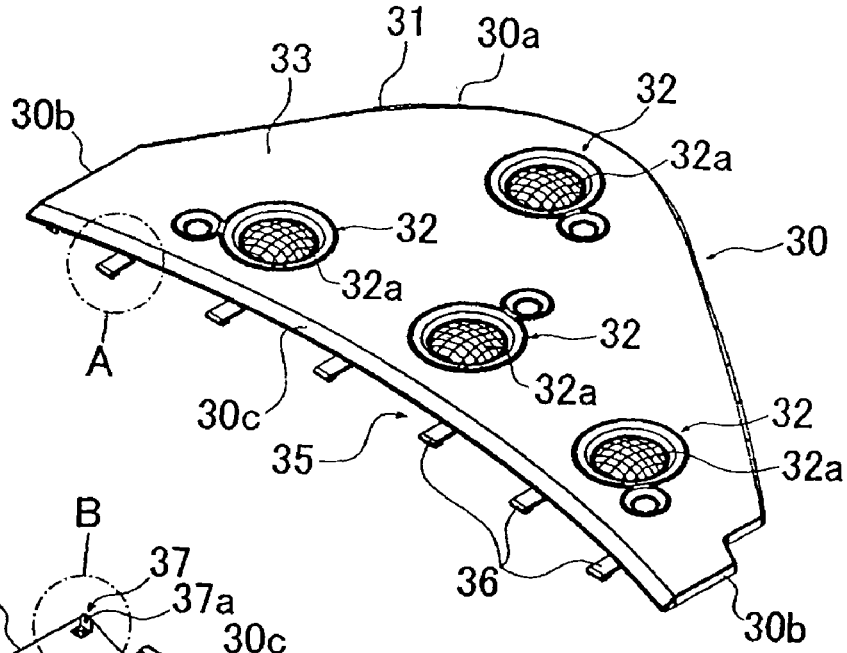
FIG. 3A is an upper perspective view of a middle plate.
Figure 3B:
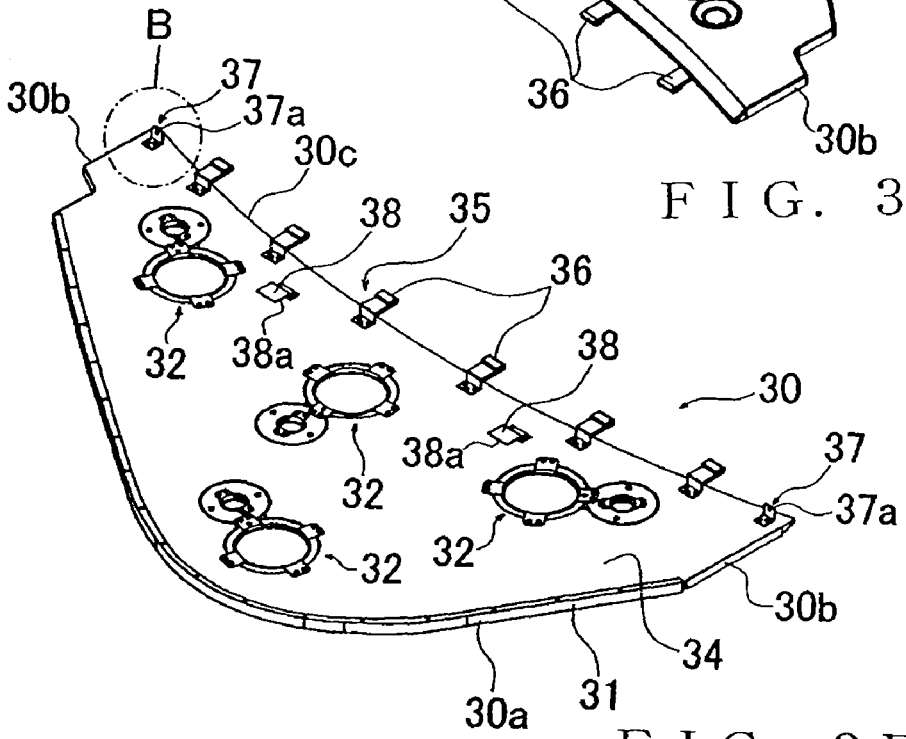
FIG. 3B is a lower perspective view of the middle plate.
Figure 3C:
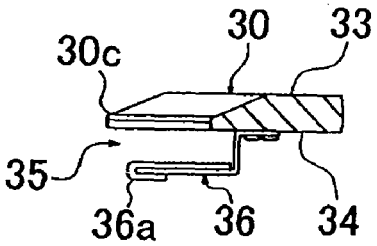
FIG. 3C is a side sectional view showing in enlarged scale a section encircled at A of FIG. 3A.
Figure 3D:
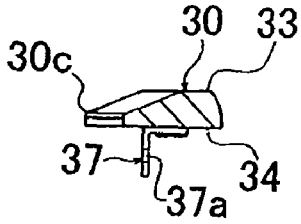
FIG. 3D is a side sectional view showing in enlarged scale a section encircled at B of FIG. 3B.

FIG. 3A is an upper perspective view of the middle plate 30, FIG. 3B is a lower perspective view of the middle plate 30, FIG. 3C is a side sectional view showing in enlarged scale a section encircled at A of FIG. 3A, and FIG. 3D is a side sectional view showing in enlarged scale a section encircled at B of FIG. 3B. The middle plate 30, which is a flat plate-shaped member formed of wood, has a shape defined by: the rear end edge portion 30*a* curved along the inner periphery of the rear side plate 12 and left and right side plates 11 defining the accommodating section 20; generally straight left and right side edge portions 30*b*; and a slightly curved front end edge portion 30*c*. A thin plate-shaped cushion member 31, formed of a resilient material like urethane, is affixed at least to the rear end edge portion 30*a*. Further, the middle plate 30 has a plurality of (four in the illustrated example) sound emitting holes 32. Each of the sound emitting holes 32 is constructed by fixing a net-like perforated metal sheet 32*a*, having a multiplicity of small holes, to the edge of a through-hole formed in the middle plate 30 and shaped along the outer periphery of one of the speakers 50. Each of the sound emitting holes 32 is formed in a portion of the middle plate 30 positionally corresponding to a respective one of the speakers 51 of the speaker box 50 (FIG. 2) provided in the accommodating section 20.

The middle plate 30 has a fitting section 35 provided on the underside 34 of the front end edge portion 30*c* for fitting therein of a rear end edge portion 40*a* of the soundboard 40. The fitting section 35 is a forwardly facing channel-shaped section which includes the underside 34 of the front end edge portion 30*c* and a plurality of angle members 36 fixed to the underside 34. Each of the angle members 36 is in the form of a plate-shaped metal member formed to have three portions: an upper horizontal portion fixed to the underside 34 of the front end edge portion 30*c*; a vertical portion bent generally perpendicularly from the front end of the horizontal portion, i.e. generally vertically downward away from the underside 34; and a lower horizontal portion extending forward in parallel to the underside 34. Namely, the fitting section 35 is defined by or between the angle members 36 and the underside 34 of the front end edge portion 30*c*. As shown in FIGS. 3A and 3B, the angle members 36 are provided at predetermined intervals along the underside 34 of the front end edge portion 30*c* of the middle plate 30. The fitting section 35 has a vertical dimension substantially equal to the thickness of the rear end edge portion 40*a* of the soundboard 40, so that the rear end edge portion 40*a* of the soundboard 40 is sandwiched vertically or in its thickness direction by the fitting section 35.

As shown in FIGS. 3B and 3D, fixing pieces (fixation portions) 37 are provided on left and right side regions of the underside 34 of the middle plate 30 near the front end edge portion 30*c*, and the fixing pieces 37 have the same shape. More specifically, each of the fixing pieces 37 is in the form of a generally L-shaped metal plate having two portions, and one of the two portions is fixed to the underside 34 while the other portion extends downward from the front end of the one portion away from the underside 34. These fixing pieces 37 are provided for fastening and fixing the middle plate 30 to the body section 10 and each have a bolt hole 37*a* for passage therethrough of a bolt (fastener member) 16 (see FIG. 5).

Figure 5A:
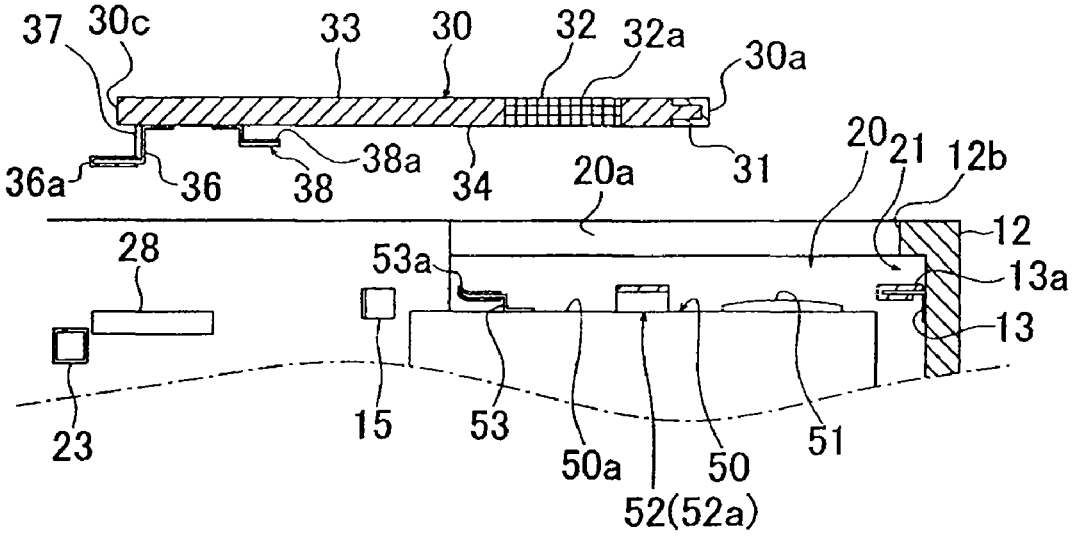
FIGS. 5A to 5C are conceptual views explanatory of a sequence of operations for mounting the middle plate to an accommodating section.

Further, as shown in FIG. 3B, connecting members 38 are fixed to the underside 34 of the middle plate 30. Each of the connecting members 38 is in the form of a plate-shaped metal member formed to have three portions: an upper horizontal portion fixed to the underside 34 of the middle plate 30; a vertical portion bent generally perpendicularly from the rear end of the horizontal portion, i.e. generally vertically downward away from the underside 34; and a lower horizontal portion extending rearward from the lower end of the vertical portion in parallel to the underside 34. Thus, a gap is defined by or between each of the connecting members 38 and the underside 34 of the middle plate 30, as seen in FIG. 5A. The connecting members 38 are disposed near the front end edge portion 30*c*, one on each of left and right side regions of the underside 34 of the middle plate 30. Further, a cushion member 38*a*, formed of a resilient material like urethane, is affixed to the upper surface of the lower horizontal portion of each of the connecting members 38.

Figure 4A:
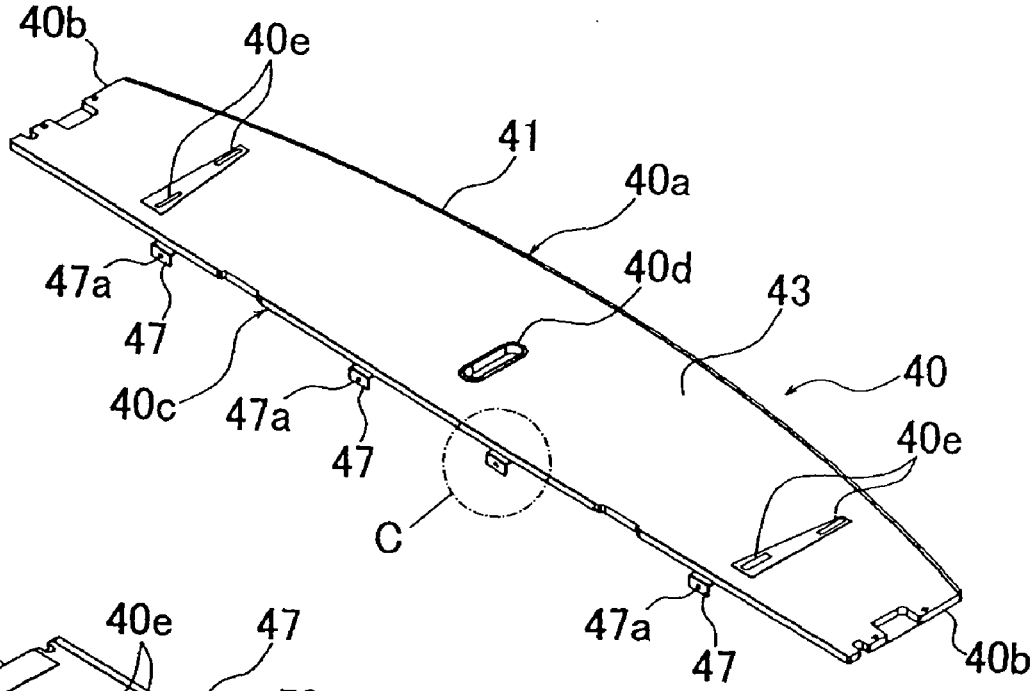
FIG. 4A is an upper perspective view of a soundboard.
Figure 4B:
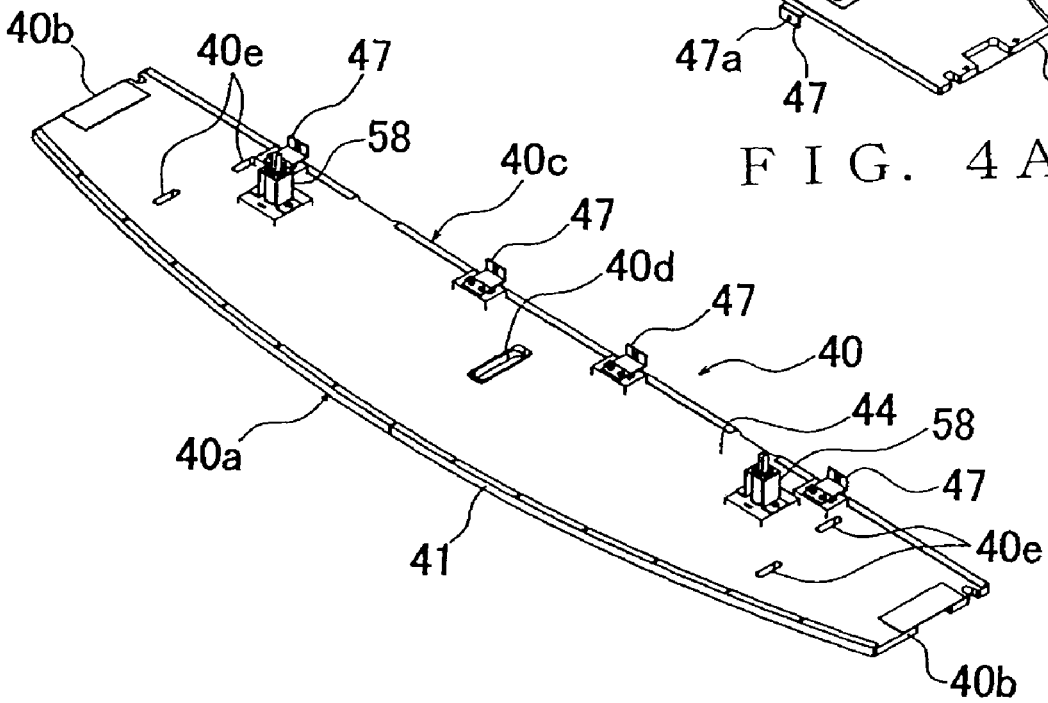
FIG. 4B is a lower perspective view of the soundboard.
Figure 4C:
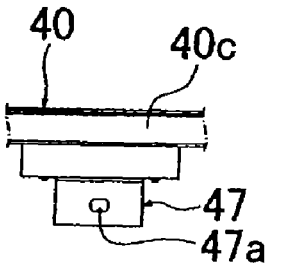
FIG. 4C is an enlarged front view showing a section encircled at C of FIG. 4A.
Figure 4D:
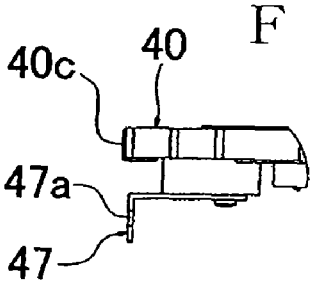
FIG. 4D is an enlarged side view showing the section encircled at C.

FIG. 4A is an upper perspective view of the soundboard 40, FIG. 4B is a lower perspective view of the soundboard 40, FIG. 4C is an enlarged front view showing a section encircled at C of FIG. 4A, and FIG. 4D is an enlarged side view showing the section encircled at C. The soundboard 40 is a flat plate-shaped member formed of wood and has a horizontally elongated rectangular shape, which has a rear end edge portion 40*a* slightly curved along the slightly curved front end edge portion 30*c* of the middle plate 30, generally straight left and right side edge portions 40*b*, and a generally straight front edge 40*c*. The soundboard 40 has an opening 40*d* elongated in the front-rear direction and formed through the thickness of a middle region thereof to permit passage therethrough of a support rod (not shown) for supporting the music rest 55. Further, small openings 40*e* elongated in the front-rear direction are formed through the thickness of regions of the soundboard 40 adjacent to the left and right side edge portions of the soundboard 40 to permit insertion therethrough of pins 26*a* of mounting members 26 provided on the body section 10.

Furthermore, a plurality of transducers (vibration generators) 58 are mounted on the underside 44 of the soundboard 40 near the front end edge portion 40*c* for imparting the soundboard 40 with vibrations corresponding to a tone to be performed by the electronic piano 1 (i.e., a tone signal to be electrically generated by the electronic piano 1). In the illustrated example, one such transducer 58 is provided on each of left and right side regions of the underside 44 of the soundboard 40. The transducers 58 are connected via connectors to a circuit board mounted beneath the soundboard 40, for vibrating the soundboard 40 in accordance with an input tone signal. Note that the transducers 58 may be caused to operate only in response to a tone signal of a high pitch (or treble) range. A plurality of fixing pieces (fixation portions) 47 are fixed to the undersurface 44 of the soundboard 40 and at predetermined horizontal intervals along the front end edge portion 40*c*, and the fixing pieces 47 have the same shape. More specifically, as shown in FIGS. 4C and 4D, each of the fixing pieces 47 is in the form of a generally L-shaped metal plate having two portions, and one of the two portions is fixed to the underside 44 of the soundboard 40 while the other portion extends downward from the front end of the one portion away from the underside 44. These fixing pieces 47 are provided for fastening and fixing the sound board 40 to the accommodating section 20 by being fixed to the support member (fixation portion) 23 of the accommodating section 20 by means of bolts (fastener members) 48 (see FIG. 7). For that purpose, each of the fixing pieces 47 has a bolt hole 47*a* for passage therethrough of a bolt (fastener member) 48.

As shown in FIG. 2, the music rest 55 is formed in a generally rectangular flat plate shape. The music rest 55 is pivotably mounted at its front (lower) end edge portion 55*a* to the support member 23 immediate beneath the soundboard 40 by means of hinges 56 in such a manner that an inclination angle of the music rest 55 is adjustable via a support rod (not shown) horizontally movably connected to a guide member 27. Further, the decorative rests 57 are fixed adjacent to left and right side edge portions of the music rest 55 by means of the pins 26*a* projecting upwardly from the mounting members 26 through the openings 40*e* formed in the soundboard 40. The decorative rests 57 can be used for placing thereon small articles, candle holders or the like.

The speaker box 50 is accommodated in a rear lower region of the accommodating section 20, and a plurality of (four sets in the illustrated example) of speakers 51 are placed at predetermined horizontal intervals on the upper surface (i.e., speaker placing surface) 50*a* of the speaker box 50. Further, spacer members 52 each having a small rectangular columnar shape are provided at suitable horizontal intervals between the speakers 51. A cushion member 52*a*, formed of a resilient material like urethane, is affixed to the upper surface of each of the spacer members 52. During operations for mounting the middle plate 30 to the accommodating section 20, the spacer members 52 having the cushion member 52*a* affixed thereto can function as shock absorbing members that prevent the rear end edge portion 30*a* and the underside of the middle plate 30 from colliding against the speaker box 50 and speakers 51.

Further, connection members 53 are fixed to the speaker placing surface 50*a*. Each of the connection members 53 is in the form of a plate-shaped metal member formed to have three portions: a lower horizontal portion fixed to the speaker placing surface 50*a*; a vertical portion bent generally perpendicularly upward from the front end of the horizontal portion, i.e. generally vertically upward away from the speaker placing surface 50*a*; and an upper horizontal portion extending forward in parallel to the speaker placing surface 50*a*. A gap is defined by or between each of the connection members 53 and the speaker placing surface 50*a*, as seen in FIG. 5. The connection members 53 are disposed in positional corresponding relation to the connecting members 38 fixed to the underside 34 of the middle plate 30. The connecting members 38 are disposed near the front end edge of the speaker placing surface 50*a*, one on each of left and right side regions of the speaker placing surface 50*a*. Further, a cushion member 53*a*, formed of a resilient material like urethane, is affixed to the lower surface of the upper horizontal portion of each of the connection members 53.

Further, fixation pieces 15 are provided on the inner surface 11*a* of each of the left and right side plates 11 in correspondence with the fixing pieces 37. Each of the fixation pieces 15 is in the form of a generally L-shaped metal member having one portion fixed to the inner surface 11*a* of the corresponding side plate 11 and another portion extending inwardly of the accommodating section 20 from the one portion away from the inner surface 11*a*. These fixation pieces 15 are provided for allowing the middle plate 30 to be mounted to the accommodating section 20 by fixedly engaging with the fixing pieces 37 of the middle plate 30 by means of the bolts 16 (see FIG. 5). Furthermore, a support member 28 for supporting the soundboard 40 is provided on the inner surface 11*a* of each of the left and right side plates 11. Each of the support members 28 is provided as a small protrusion of a generally rectangular columnar shape and supports thereon the underside 44 of one of the left and right side edge portions 40*b* of the soundboard 40 mounted to the accommodating section 20. Note that only the fixation piece 15 and support member 28 fixed to the inner surface 11*a* of the left side plate 11 are shown in FIG. 2.

Figure 5B:
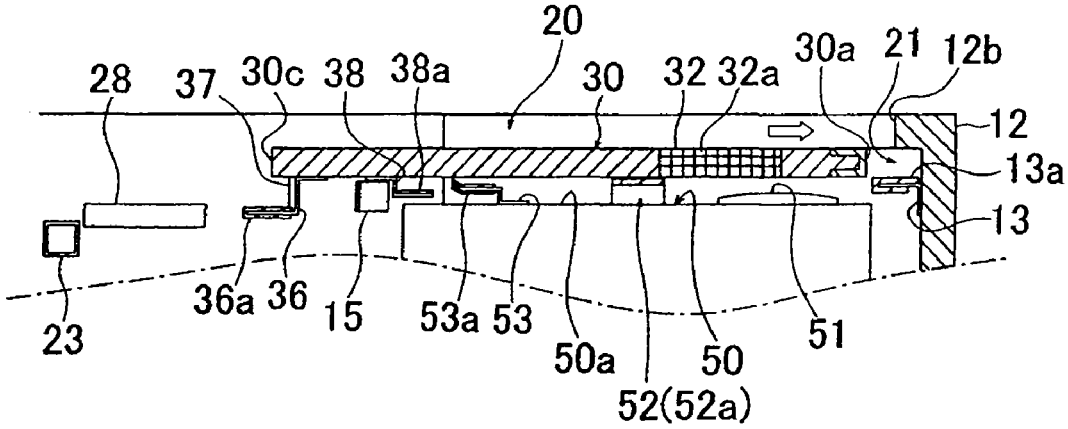
Figure 5C:
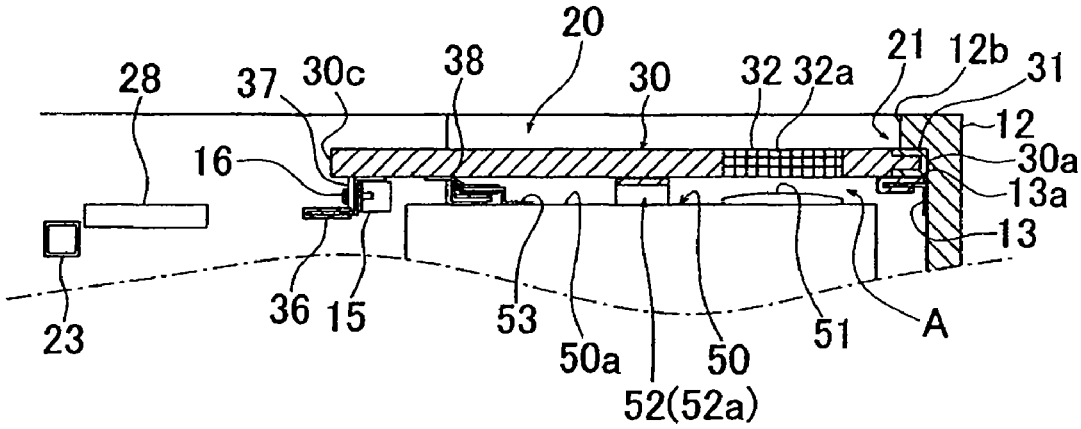

The following describe a sequence of operations for mounting the middle plate 30 and the soundboard 40 to the accommodating section 20 to assemble a casing in the aforementioned casing structure. The middle plate 30 and the soundboard 40 are mounted to the accommodating section 20 in the order mentioned, i.e. first the middle plate 30 and then the soundboard 40. FIGS. 5A to 5C are conceptual views explanatory of a sequence of operations for mounting the middle plate 30 to the accommodating section 20. The fixing piece 37 and angle member 36 of the middle plate 30 are shown in FIGS. 5A to 5C as partially overlapping with each other at the same position; actually, however, the fixing piece 37 and angle member 36 on each of left and right side regions of the middle plate 30 do not overlap with each other; namely, the fixing piece 37 is located closer to the corresponding side plate 11 than the angle member 36 as shown in FIG. 3.

To mount the middle plate 30 to the accommodating section 20, the middle plate 30 shown in FIG. 5A is first inserted into the accommodating section 20 through the opening portion 20*a* and then placed in a horizontal orientation at a position slightly lower than the opening portion 20*a* (i.e., at a height position of the fitting section 21) as shown in FIG. 5B. Then, the middle plate 30 is slid horizontally rearward, so that the rear end edge portion 30*a* of the middle plate 30 is moved to be fitted into the fitting section 21 and also each of the connecting members 38 is inserted into the corresponding connection member 53, i.e. between the speaker placing surface 50*a* and the upper horizontal portion of the connection member 53. Then, as shown in FIG. 5C, each of the connecting members 38 and the corresponding connection member 53 engage with each other in a vertically overlapping state with the rear end edge portion 30*a* of the middle plate 30 fitted fully into the fitting section 21. At that time, the rear end edge portion 30*a* of the middle plate 30 resiliently fits into the fitting section 21 by the provision of the cushion member 31 affixed to the rear end edge portion 30*a* and the cushion member 13*a* affixed to each of the angle members 13, and each of the connecting members 38 and the corresponding connection member 53 resiliently engage with each other. Further, at that time, each of the fixing pieces 37 abuts against the corresponding fixation piece 15 of the accommodating section 20, and then each of the fixing pieces 37 and the corresponding fixation piece 15 are fixed together by means of the bolt 16. In this way, the mounting of the middle plate 30 to the accommodating section 20 is completed.

Figure 6:
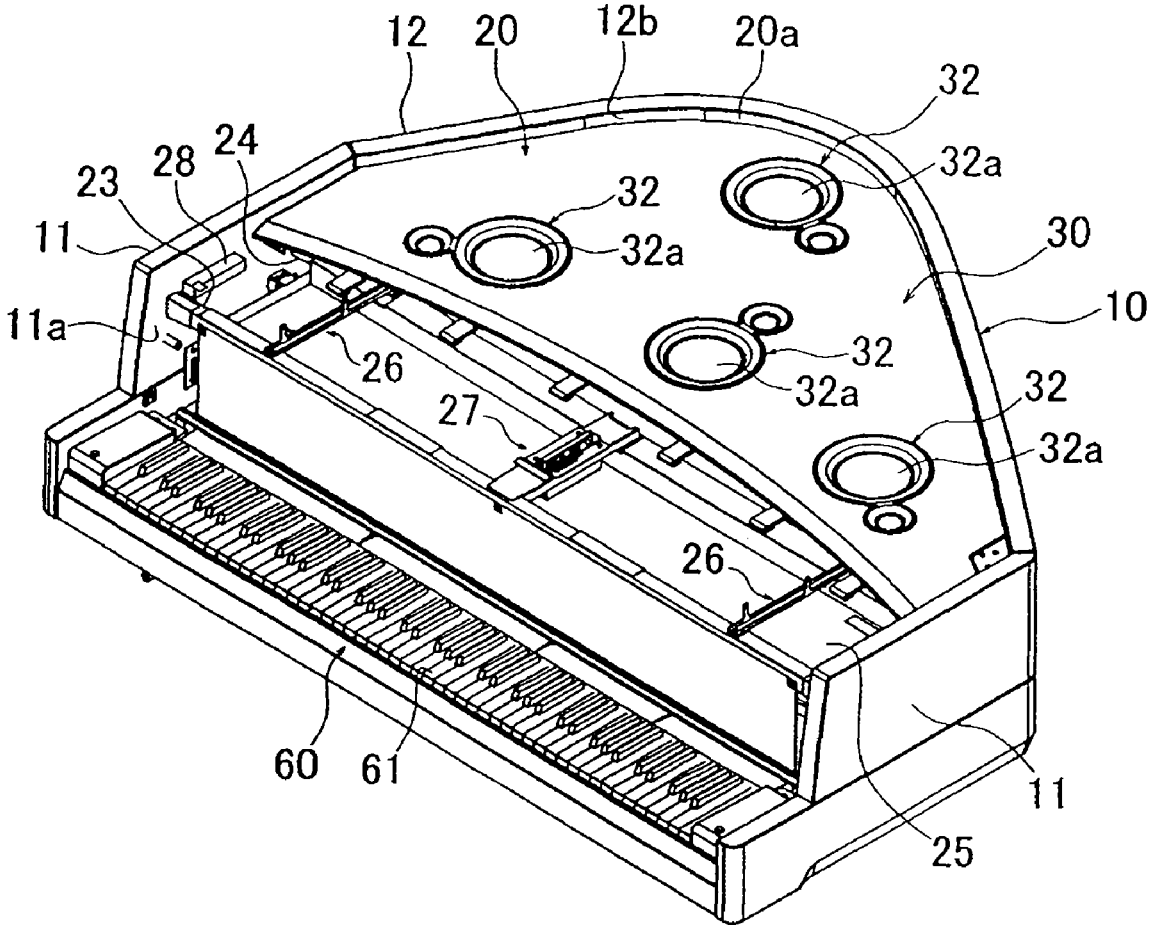
FIG. 6 is a perspective view showing the body section with the middle plate appropriately mounted to the accommodating section.

FIG. 6 is a perspective view showing the body section 10 with the middle plate 30 appropriately mounted to the accommodating section 20. As shown, the middle plate 30 is mounted in a horizontal orientation at a position slightly lower than the opening portion 20*a* of the accommodating section 20 and thereby covers the speaker placing surface 50*a* (see FIG. 1) of the speaker box 50 in a rear region of the accommodating section 20. In this state, a gap A is defined between the speaker placing surface 50*a* and the middle plate 30 as shown in FIG. 5C.

Figure 7A:
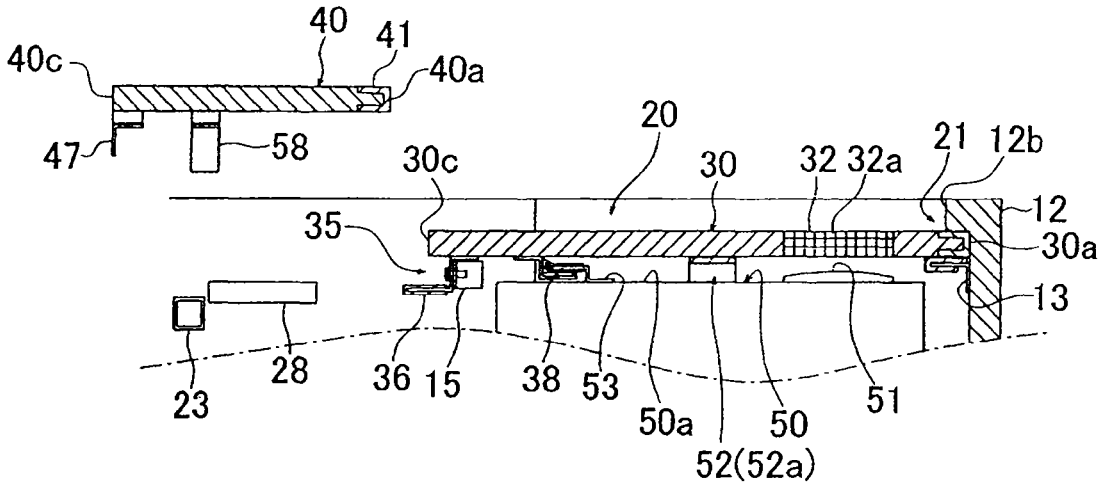
FIGS. 7A to 7C are conceptual views explanatory of a sequence of operations for mounting a soundboard to the accommodating section.
Figure 7B:
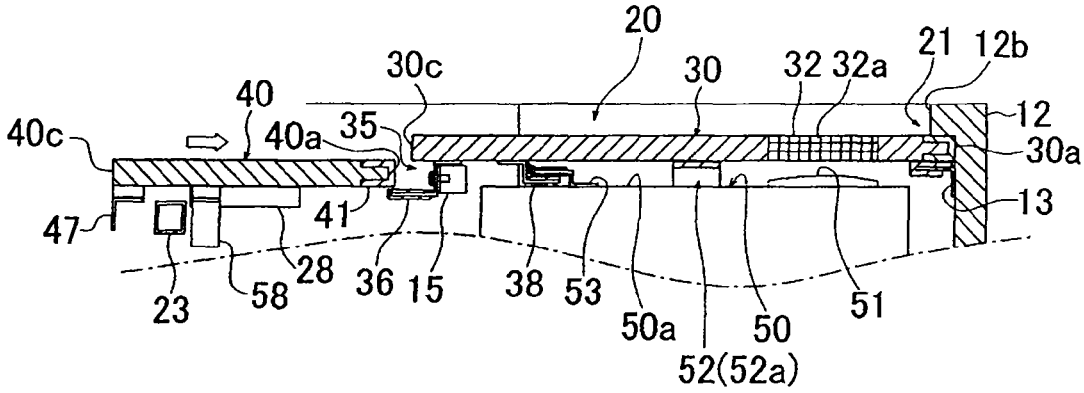
Figure 7C:
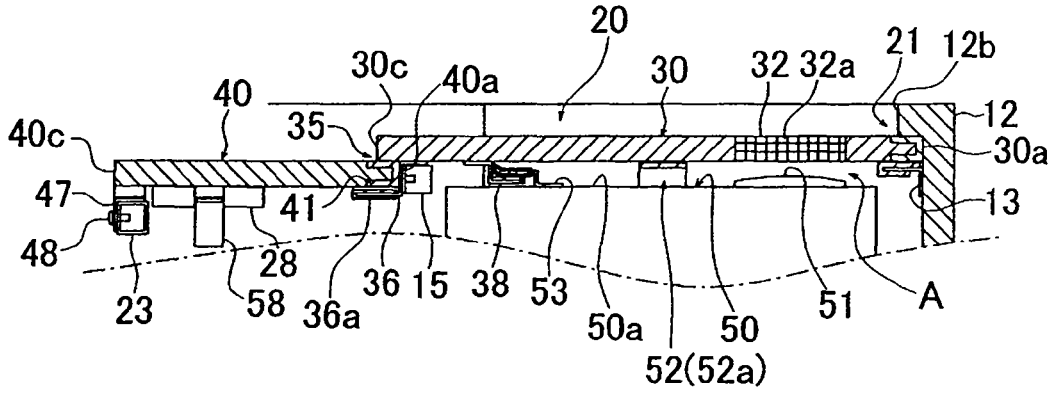

FIGS. 7A to 7C are conceptual views explanatory of a sequence of operations for mounting the soundboard 40 to the accommodating section 20. To mount the soundboard 40 to the accommodating section 20, the soundboard 40 shown in FIG. 7A is first inserted into the accommodating section 20 through the opening portion 20*a* and then placed in a horizontal orientation in front of the middle plate 30 and at a position lower than the middle plate 30 (i.e., at a height position of the fitting section 35) as shown in FIG. 7B. At that time, the pins 26*a* of the mounting members 26 vertically project above the soundboard 40 through the openings 40*e* formed in the soundboard 40, and the guide member 27 is positioned in opposed relation to the elongated opening 40*d* formed in the soundboard 40, although not specifically shown. Then, the soundboard 40 is slid horizontally rearward, so that the rear end edge portion 40*a* of the soundboard 40 is moved to be fitted into the fitting section 35 of the middle plate 30. In this case too, the rear end edge portion 40*a* of the soundboard 40 resiliently fits into the fitting section 35 by the provision of the cushion member 41 affixed to the rear end edge portion 40*a* and the cushion member 36*a* affixed to each of the angle members 36. Then, as shown in FIG. 7C, each of the fixing pieces 47 of the soundboard 40 abuts against the support member 23 with the rear end edge portion 40*a* of the soundboard 40 fitted fully into the fitting section 35. Then, each of the fixing pieces 47 and the support member 23 are fixed together by means of the bolt 48. In this way, the mounting of the soundboard 40 to the accommodating section 20 is completed.

Figure 8:
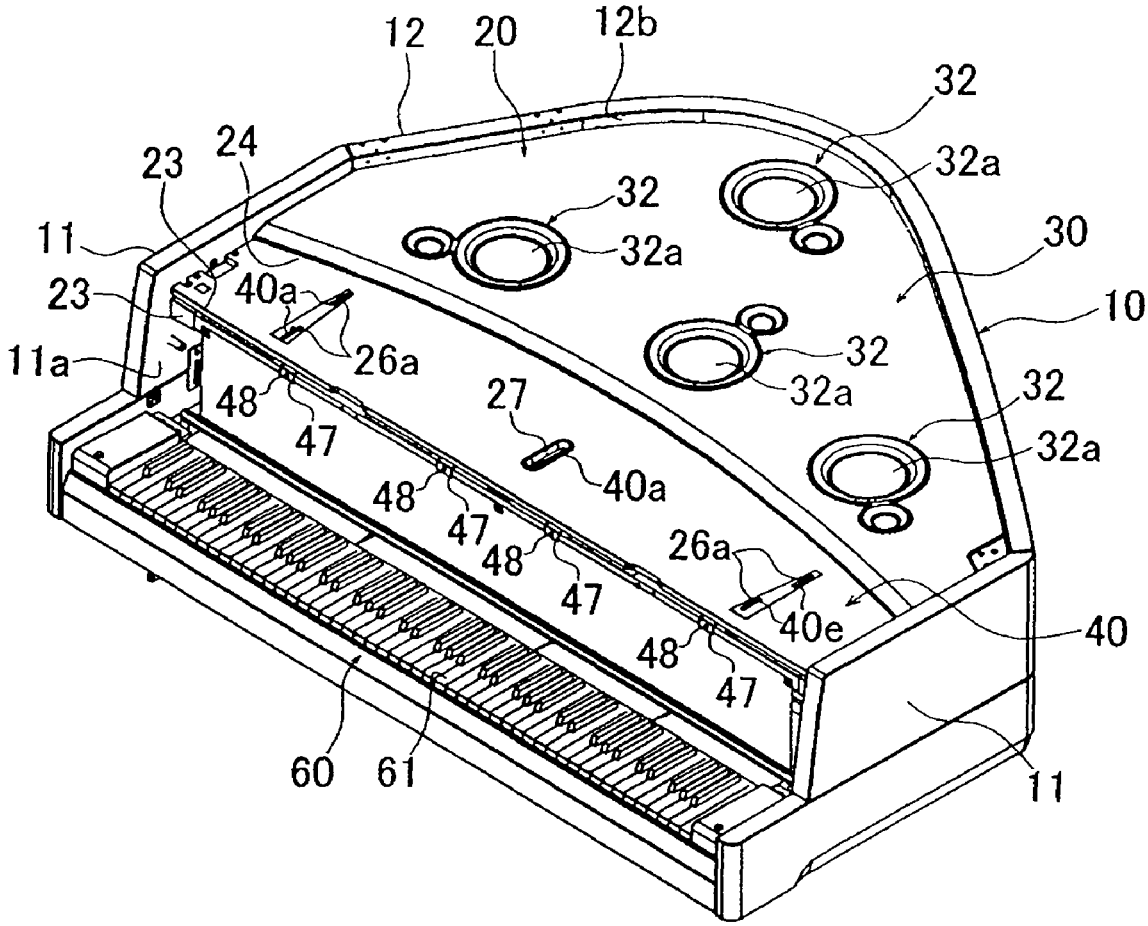
FIG. 8 is a perspective view showing the body section with the middle plate and the soundboard appropriately mounted to the accommodating section.

FIG. 8 is a perspective view showing the body section 10 with the middle plate 30 and soundboard 40 appropriately mounted to the accommodating section 20. As shown, the soundboard 40 is placed in a horizontal orientation in front of the middle plate 30 and at a position lower than the middle plate 30 and thereby covers an area between the keyboard 60 and the speaker box 50 in a front region of the accommodating section 20.

Then, the music rest 55 is mounted to the upper surface 43 of the soundboard 40, and the decorative rests 57 are mounted adjacent to the left and right sides of the music rest 55. To mount the decorative rests 57, respective outer side edge portions of the decorative rests 57 are fitted into the inner surfaces 11*a* of the corresponding side plates 11, and then fixation portions (not shown) provided on the lower surfaces of the decorative rests 57 are fixed to the pins 26*a* of the mounting members 26 by means of not-shown bolts. Use of such a fixation structure can prevent the bolts, fixing the decorative rests 57, from appearing on the exterior of the electronic piano 1, i.e. from being visible from outside the electronic piano 1. In the embodiment of the casing structure assembled in the aforementioned manner, the middle plate 30 and soundboard 40 appropriately mounted to the accommodating section 20 are visible from outside the electronic piano 1 when the back lid 4 is in the opened or raised position, and thus, the middle plate 30 and soundboard 40 constitute part of the outer appearance of the electronic piano 1.

According to the above-described embodiment of the casing structure, when the middle plate 30 and the soundboard 40 are mounted to the accommodating section 20, the rear end edge portion 30*a* of the middle plate 30 is fitted into the fitting section 21, but also the rear end edge portion 40*a* of the soundboard 40 is fitted into the fitting section 35 of the middle plate 30. In this way, the embodiment of the casing structure can minimize the number of the portions of the middle plate 30 to be fixed by the bolts 16 and the number of the portions of the soundboard 40 to be fixed by the bolts 48. Consequently, the embodiment of the casing structure can enhance the assembling efficiency and ease of the middle plate 30 and the soundboard 40 and thereby allows the operations for mounting the middle plate 30 and soundboard 40 to be performed efficiently in a short time. Further, because not only the middle plate 30 and the soundboard 40 are mounted by being fitted into the fitting sections 21 and 35 as noted above but also the middle plate 30 and the soundboard 40 are resiliently fitted into the accommodating section 20 and the middle plate 30, respectively, via the cushion members 31 and 13*a* and cushion members 41 and 36*a*, the embodiment of the casing structure can effectively absorb (tolerate) influences of deviations, from designed sizes, of actual sizes of the middle plate 30 and soundboard 40 and deformation, such as warpage, of the middle plate 30 and soundboard 40, during and after assemblage of the casing of the electronic piano 1. As a result, the embodiment of the casing structure can not only facilitate the mounting operations of the middle plate 30 and soundboard 40 but also stabilize fixed states of the middle plate 30 and soundboard 40 after the mounting. Further, by the engagement between the connecting members 38 and the connection members 53, the embodiment of the casing structure can prevent an inner portion of the middle plate 30 from undesirably lifting up due to deformation, such as warpage, of the middle plate 30.

Further, with the embodiment of the casing structure, where the bolts 16 fixing the middle plate 30 and the bolts 48 fixing the soundboard 40 are disposed on the underside 34 of the middle plate 34 and the underside 44 of the soundboard 40, the portions, fastened by the bolts 16 and 48, of the middle plate 30 and soundboard 40 duly mounted on the accommodating section 20 can be prevent from being visible from outside the accommodating section 20 and hence the electronic piano 1. As a result, the electronic piano 1 can have an improved outer appearance with, for example, a sense of high quality. Further, with the middle plate 30 mounted on the accommodating section 20, the speakers 51 on the speaker placing surface 50*a* can be hidden or invisible from outside the electronic piano 1. Thus, even when the back lid 4 is in the opened or raised position, the speaker box 50 and speakers 51 provided in the accommodating section 20 can be prevented from being directly visible from outside the electronic piano 1, so that the electronic piano 1 can have an even further improved outer appearance.

Further, with the embodiment of the casing structure, the rear end edge portion 30*a* of the middle plate 30 is fitted into the fitting section 21 as the middle plate 30 is slid horizontally in the front-to-rear direction in the accommodating section 20, and the rear end edge portion 40*a* of the soundboard 40 is fitted into the fitting section 35 of the middle plate 30 as the soundboard 40 is slid horizontally in the front-to-rear direction, as set forth above. Namely, the middle plate 30 and the soundboard 40 can be fitted into the fitting sections 21 and 35 to be mounted in place by the middle plate 30 and the soundboard 40 being merely slid in one direction. Therefore, the embodiment of the casing structure can facilitate the mounting operations of the middle plate 30 and the soundboard 40.

Further, according to the embodiment of the casing structure, the soundboard 40 can be mounted to the accommodating section 20 using the fitting section 35 provided on the middle plate 30. Thus, although the plate-shaped member to be mounted to the accommodating section 20 comprises two separate plate-shaped members, i.e. the middle plate 30 and the soundboard 40, the embodiment of the casing structure can effectively minimize the number of the portions of the middle plate 30 and soundboard 40 to be fixed by the bolts 16 and 48. Further, because the plate-shaped member to be mounted to the accommodating section 20 comprises two separate plate-shaped members, i.e. the middle plate 30 and the soundboard 40, the middle plate 30 and the soundboard 40 can be constructed of different materials. Thus, it is possible to construct the middle plate 30 using a relatively inexpensive material while using an optimal material for the soundboard 40 as an acoustic component, so that the necessary manufacturing cost can be reduced. Furthermore, because the middle plate 30 and the soundboard 40 are provided as separate plate-shaped members, the embodiment of the casing structure allows only the soundboard 40 to be vibrated by the transducers 58 as set forth above. In this way, the embodiment of the casing structure permits reduction in size and output power of the component parts, such as the transducers 58, required for generation of vibrations, as compared to the case where only one plate-shaped member is mounted to the accommodating section 20 as in the conventionally-known structure discussed earlier in this specification. Furthermore, because the soundboard 40 provided in a front region of the accommodating section 20 is vibrated, the embodiment of the casing structure allows vibration sounds to be generated only from the soundboard 40 located near the human player, to thereby enhance responsiveness of the vibration sounds to be transmitted to the human player. Furthermore, with the rear end edge portion 40*a* of the soundboard 40 resiliently fitted in the second fitting section 35, the embodiment of the casing structure can achieve an enhanced freedom of vibration of the soundboard 40 and thereby enhance an acoustic effect based on the vibrations of the soundboard 40.

Although a preferred embodiment of the present invention has been described above, the present invention is not limited to the preferred embodiment and may be variously modified within the scope of the technical idea presented in the specification and drawings and the following claims. For example, whereas the preferred embodiment has been described above in relation to the case where the cushion member (shock absorbing member) is provided both on the rear end edge portion 30*a* of the middle plate 30 and on the angle members 13, such a cushion member (shock absorbing member) may alternatively be provided only on one of the rear end edge portion 30*a* of the middle plate 30 and the angle members 13. Similarly, whereas the preferred embodiment has been described above in relation to the case where the cushion member (shock absorbing member) is provided both on the connecting members 38 and on the connection members 53, such a cushion member may alternatively be provided only on one of the connecting members 38 and the connection members 53. Furthermore, each of the aforementioned cushion members is only one example of the shock absorbing member to be employed in the present invention, and the shock absorbing member in the present invention may be constructed in a different manner from the above-described.

Further, whereas the fixing pieces 47 for fixing the soundboard 40 to the body section 10 by means of the bolts have been described as provided on the underside 44 of the soundboard 40, the soundboard 40 may be fixed in a different manner than the aforementioned. For example, fastener-based fixation portions for fixing left and right side edge portion regions of the soundboard 40 from above the upper surface 43 may be provided, and the decorative rests 57 may be mounted in such a way to cover the fastener-based fixation portions, although not particularly shown. This construction too can prevent the fastener members, fixing the soundboard 40, from appearing on the exterior of the electronic piano 1.

Furthermore, whereas the preferred embodiment of the casing structure the present invention has been described above as applied to the grand-piano type electronic piano 1, the casing structure the present invention may be applied to other types of electronic musical instruments.

The present application is based on, and claims priority to, Japanese Patent Application No. 2008-325686 filed on Dec. 22, 2008. The disclosure of the priority application, in its entirety, including the drawings, claims, and the specification thereof, is incorporated herein by reference.

What is claimed is:

1. A casing structure of an electronic musical instrument, comprising:

a body section;

an accommodating section provided in said body section and having at least one portion thereof adapted to be opened;

a plate-shaped member to be mounted to said accommodating section;

a fitting section provided on said body section for fitting therein part of an end edge portion of said plate-shaped member;

fixation portions provided on left and right side regions of a surface of said plate-shaped member facing inwardly of said accommodating section and adapted to be fixed to said body section; and fastener members for fastening and fixing said fixation portions to corresponding portions provided on said body section in correspondence with said fixation portions, wherein said plate-shaped member is mounted to said accommodating section by said fixation portions being fastened and fixed to said corresponding portions by means of said fastener members with the part of the end edge portion of said plate-shaped member fitted in said fitting section.

2. The casing structure as claimed in claim 1, wherein a resilient shock absorbing portion is provided on at least one of said fitting section and the end edge portion of said plate-shaped member to be fitted into said fitting section.

3. The casing structure as claimed in claim 1, wherein a speaker is provided in said accommodating section, and, by said plate-shaped member mounted to said accommodating section, at least part of the speaker is hidden to be invisible from outside said accommodating section.

4. The casing structure as claimed in claim 3, wherein the speaker comprises a plurality of speakers placed on a speaker placing surface in said accommodating section, the speaker placing surface facing said plate-shaped member mounted to said accommodating section, and said plate-shaped member has sound emitting holes formed in positions thereof corresponding to individual ones of the plurality of speakers, a gap being defined between said plate-shaped member mounted to the accommodating section and the speaker placing surface.

5. The casing structure as claimed in claim 1, wherein said accommodating section is disposed in a rear region of said body section opposite from a human player of the electronic musical instrument, said fitting section is provided on a rear side plate surrounding a rear side of said accommodating section or surrounding a region of said accommodating section extending from the rear side to at least portions of left and right sides of said accommodating section, and the end edge portion of said accommodating section is fitted into said fitting section as said plate-shaped member is moved in said accommodating section from a human player side toward the rear side.

6. The casing structure as claimed in claim 1, wherein said plate-shaped member comprises a first plate-shaped member to be fitted into a first setting section provided in said body section and a second plate-shaped member to be mounted to said mounting section together with said first plate-shaped member, which further comprises: a second fitting section provided on another end edge portion of said first plate-shaped member than the end edge portion to be fitted into said first setting section, part of an end edge portion of said second plate-shaped member being fitted into said second fitting section; a second fixation portion provided on a surface of said second plate-shaped member facing inwardly of said accommodating section and adapted to be fixed to said body section; and a second fastener member for fastening and fixing said second fixation portion to said body section, and wherein said second plate-shaped member is mounted to said accommodating section by the part of the end edge portion of the second plate-shaped member being fitted into said second fitting section and said second fixation portion being fastened and fixed to said body section by means of said second fastener member with said first plate-shaped member mounted to said accommodating section.

* * * * *